US005565835A

United States Patent [19]

Groehl

[11] Patent Number: 5,565,835

[45] Date of Patent: Oct. 15, 1996

[54] SUBSTANTIAL NULLIFICATION OF EXTERNAL MAGNETIC FIELDS AND LORENTZ FORCES REGARDING TOROIDAL INDUCTORS

[75] Inventor: Lawrence R. Groehl, Eatontown, N.J.

[73] Assignee: The United States of America as represented by the Secretary of the Army, Washington, D.C.

[21] Appl. No.: 260,151

[22] Filed: Jun. 13, 1994

[51] Int. Cl.[6] ..... H01F 3/00

[52] U.S. Cl. ..... 336/181; 336/183; 336/184; 336/186; 336/225

[58] Field of Search ..... 336/181, 183, 336/184, 186, 187, 225; 324/117

[56] References Cited

U.S. PATENT DOCUMENTS

| | | | |
|---|---|---|---|
| Re. 33,345 | 9/1990 | Sylvester et al. | 336/180 |
| 3,439,305 | 4/1969 | Klein | 335/299 |
| 5,438,257 | 8/1995 | Berkcan | 324/117 |

*Primary Examiner*—Cassandra C. Spyrou
*Assistant Examiner*—G. R. Lord
*Attorney, Agent, or Firm*—Michael Zelenka; John M. O'Meara

[57] ABSTRACT

Main and supplemental windings are combined in a toroidal inductor to substantially nullify Lorentz Forces on the main winding and the magnetic field thereof which passes externally from the inductor.

9 Claims, 1 Drawing Sheet

SUBSTANTIAL NULLIFICATION OF EXTERNAL MAGNETIC FIELDS AND LORENTZ FORCES REGARDING TOROIDAL INDUCTORS

GOVERNMENT INTEREST

The invention described herein may be manufactured, used, and licensed by or for the United States Government for governmental purposes without the payment to me of any royalties thereon.

BACKGROUND OF THE INVENTION

Use of inductors or coils is well know in the electrical arts, such as for storing electrical energy. As the electromagnetic parameters of inductors increase however, severe problems are encountered therewith, for example in power distribution systems of electric utilities. Because of Lorentz Forces which result from the interaction of currents with magnetic fields, structural integrity becomes a primary consideration. Magnetic fields which radiate externally from many inductors are also an important consideration because energy losses result therefrom, and a hazard to life and equipment is presented thereby.

SUMMARY OF THE INVENTION

It is the general object of the present invention to substantially nullify both Lorentz Forces and external magnetic fields which are encountered with toroidal inductors.

It is a specific object of the present invention to incorporate a main winding in toroidal inductors, with its turns oriented to nullify Lorentz Forces on such inductors.

It is another specific object of the present invention to incorporate a supplemental winding in toroidal inductors, with its turns oriented to nullify magnetic fields passing externally from such inductors.

These and other objects are accomplished in accordance with the present invention by configuring the main winding as a circular toroid. In this configuration, the turns of the main winding are disposed around the arcuate axis that is symmetrically engulfed by the toroidal surface and at an oblique angle relative to that axis. The supplemental winding is configured to engulf the main winding, having the turns thereof disposed around the circular axis of the toroidal configuration with perpendicular orientation relative to that axis. Lorentz Forces are substantially nullified by fixing the oblique angle of the main winding while the ampere turns of that winding are fixed in number according to the intended purpose of the inductor, such as to store energy. As to the supplemental winding, the ampere turns thereof are fixed to derive an external magnetic field that substantially nullifies the external magnetic field associated with the main winding.

The scope of the present invention is only limited by the appended claims for which support is predicated on the preferred embodiments hereinafter set forth in the following description and the attached draftings.

DESCRIPTION OF THE PREFERRED EMBODIMENTS

Figure 1:
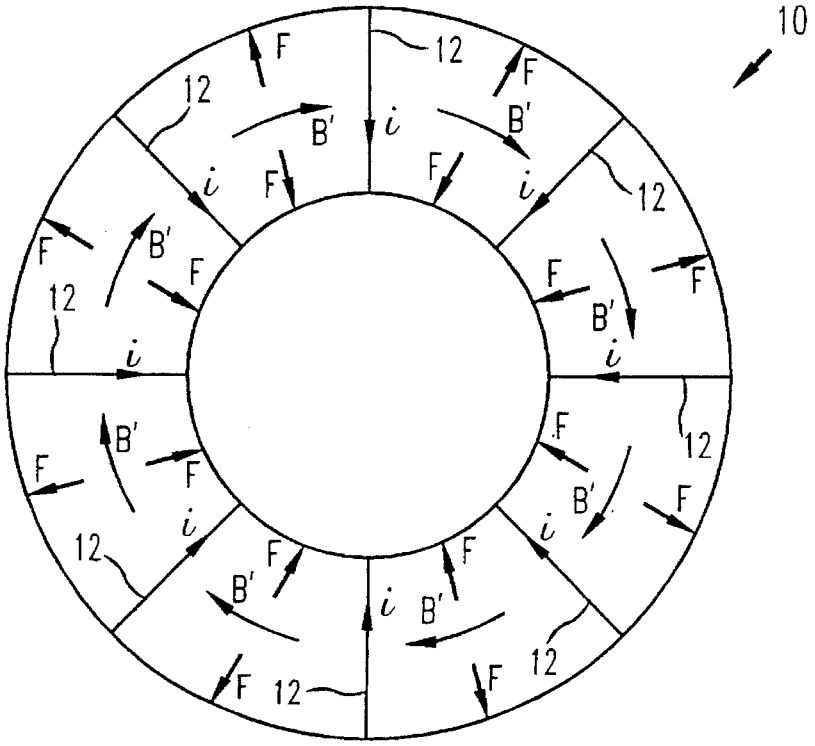
FIG. 1 is a plane view of one prior art energy storing toroidal inductor.

In the prior art energy storing inductor 10 of FIG. 1, a single winding is configured as a circular toroid. The turns 12 of this winding are disposed about the arcuate axis (not shown) around which the toroidal surface symmetrically engulfs, with perpendicular orientation relative to that axis. Only a few turns 12 are shown for the sake of clarity and to store energy in the winding, current (hereinafter i) must flow through the turns 12. In toroidal inductors having ferromagnetic cores, magnetic fields due to i only result internally, as indicated by the field density B' directed parallel to the arcuate axis. However, magnetic fields also pass externally from prior art toroidal inductors which have no ferromagnetic cores, including those having similar winding turns that are angularly oriented relative to the arcuate axis. Lorentz Forces (F in FIG. 1) result due to interaction between i and B', and are directed radially outward from the arcuate axis.

Use of toroidal inductors may be restricted due to either external fields or Lorentz Forces that are associated therewith. External fields present a significant hazard to life and equipment, while energy losses also results therefrom when reluctance is encountered thereby. Of course, design limitations predicated on structural integrity are reduced as Lorentz Forces increase.

Figure 2:
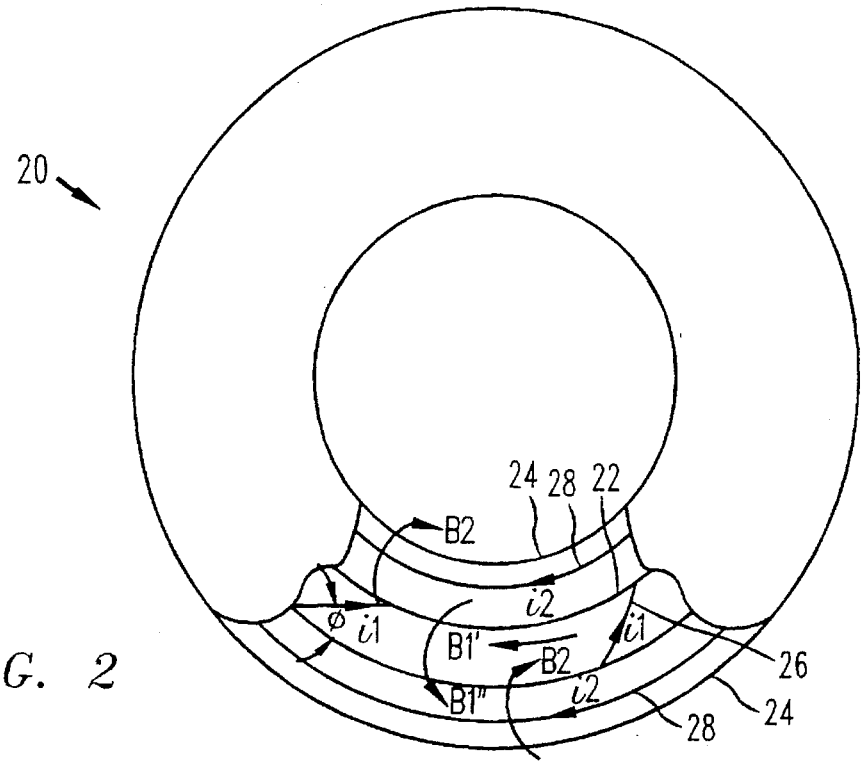
FIG. 2 is a cutaway view of one embodiment of the invention

External fields and Lorentz Forces relative to toroidal inductors are both substantially nullified with the winding structure of the present invention. As shown in FIG. 2, the inductor 20 of the present invention is a circular toroid which includes main and supplemental windings 22 and 24 respectively. The turns 26 of the main winding 22 are disposed about the arcuate axis (not shown) around which the toroidal surface symmetrically engulfs and with angular orientation relative to that axis, as indicated by oblique angle Φ (phi). Engulfing winding 22, are the turns 28 of winding 24, which are disposed about the circular axis of the toroidal configuration, with perpendicular orientation relative to that axis.

Within the concept of the invention generally, Lorentz Forces on the main winding 22 are substantially nullified, while that winding substantially serves the purpose for which the inductor 20 is intended, such as to store energy. An external magnetic field is derived with the supplemental winding 24 and substantially nullifies the external magnetic field of the main winding 22, which results when the inductor 20 has no ferromagnetic core. As is well known by those skilled in the electromagnetic arts, the number of ampere-turns derived with the windings 22 and 24 is fundamental to the determination of stored energy, Lorentz Force and magnetic field density. Consequently, even after the number of turns in the windings and the disposition thereof has been fixed, some flexibility regarding stored energy, Lorentz Force and magnetic field density is still possible by varying the current.

Lorentz Forces relative to main winding 22 are substantially nullified by fixing the oblique angle Φ at which the turns 26 thereof are oriented relative to the arcuate axis. Due to this angular disposition, components sine Φ and cosine Φ of i1 flowing through winding 22, result perpendicular to the arcuate axis and tangent to that axis respectively. These current components yield internal and external magnetic field components which are represented as field densities B1' and B1" respectively, in FIG. 2. Consequently, Lorentz Forces develop relative to the main winding 22, one equal to the cross product of B1' and i1 sine Φ which acts radially outward relative to the arcuate axis, and another equal to the cross product of B1" and i1 cosine Φ which acts radially inward relative to the arcuate axis. Since sine and cosine functions vary inversely as angle Φ changes, these Lorentz Forces will be equal and opposite for a particular value of angle Φ and therefore will nullify each other at that value.

To nullify the external magnetic field B1" that relates to main winding 22, i2 is passed through the turns 28 of supplemental winding 24 to derive magnetic field density B2 having internal and external portions relative to the energy storing inductor 20. The direction and magnitude of i2 is such that the external portion of B2 is equal and opposite to the magnetic field density B1". Consequently, the external portions of B2 and B1" nullify each other. However, the internal portion of B2 is generally in the same direction as B1" and therefore will contribute to the Lorentz Forces developed by the main winding 22. Of course, that contribution could be taken into consideration to nullify Lorentz Forces in accordance with the previous discussion herein, when determining the oblique angle Φ at which the turns 26 of the main winding 22 are oriented.

Design factors such as the magnitude of energy to be stored and whether the windings 22 and 24 are to be connected individually, in series or in parallel, must be known to determine the oblique angle, as well as the number of turns and current in each winding. Once these factors are established however, well known electromagnetic and circuit theory can be applied to make those determinations. Although such theory may be applied to obtain a magnetically contained toroidal inductor, free of Lorentz Forces, the scope of the invention is also applicable to enhance the energy storing capacity of toroidal inductors by eliminating structure for reacting to Lorentz Forces. Consequently, those skilled in the electromagnetic arts will appreciate without any further explanation that within the concept of this invention, many modifications and variations are possible to the above-disclosed embodiments of the energy storing toroidal inductor 20. Therefore, it should be understood that all such modifications and variations fall within the scope of the following claims.

What I claim is:

1. A toroidal inductor symmetrically configured about an arcuate axis which passes around a circular axis, comprising:

a main winding with the turns thereof disposed around the arcuate axis and at an angular orientation relative to that axis; and a supplemental winding disposed to engulf the main winding with the turns thereof passing around the circular axis and at a perpendicular orientation relative to that axis.

2. The inductor of claim 1 wherein the turns of the main winding are oriented relative to the arcuate axis at an oblique angle to substantially nullify Lorentz Forces thereon.

3. The inductor of claim 1 wherein the main and supplemental windings are connected in series.

4. The inductor of claim 1 wherein the main and supplemental windings are connected in parallel.

5. The inductor of claim 1 wherein the main and supplemental windings are individually connected.

6. An inductor for storing energy and having a symmetrical configuration about an arcuate axis which passes around a circular axis, comprising:

a main winding with the turns thereof disposed around the arcuate axis and at an angular orientation relative to that axis; and a supplemental winding disposed to engulf the main winding, with the turns thereof passing around the circular axis and at a perpendicular orientation relative to that axis;

wherein the angular orientation of the main winding, the number of turns in the main winding and the number of turns in the supplemental winding are determined in accordance with the intended current flow in those windings, to store the desired level of energy in the inductor, while substantially nullifying Lorentz Forces on the main winding as well as magnetic fields that pass externally therefrom.

7. The inductor of claim 6 wherein the main and supplemental windings are connected in series.

8. The inductor of claim 6 wherein the main and supplemental windings are connected in parallel.

9. The inductor of claim 6 wherein the main and supplemental windings are individually connected.

* * * * *